US007032709B2

(12) United States Patent
Hoche et al.

(10) Patent No.: US 7,032,709 B2
(45) Date of Patent: Apr. 25, 2006

(54) EXHAUST-GAS MUFFLER

(75) Inventors: Florian Hoche, Stuttgart (DE); Axel Klimmek, Schwaikheim (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 300 days.

(21) Appl. No.: 10/648,212

(22) Filed: Aug. 27, 2003

(65) Prior Publication Data

US 2004/0040783 A1 Mar. 4, 2004

(30) Foreign Application Priority Data

Aug. 27, 2002 (DE) ..... 102 39 132

(51) Int. Cl.
*F01N 1/08* (2006.01)

(52) U.S. Cl. ..... 181/268; 181/269; 181/272; 60/314

(58) Field of Classification Search ..... 181/268, 181/269, 272, 251, 275; 60/314
See application file for complete search history.

(56) References Cited

U.S. PATENT DOCUMENTS 1,740,805 A * 12/1929 Brice ..... 181/251
2,484,827 A * 10/1949 Harley ..... 181/268
3,198,284 A * 8/1965 Powers ..... 181/266
3,340,958 A * 9/1967 Conlin ..... 181/274
3,665,712 A * 5/1972 Tenney ..... 60/314
4,109,751 A * 8/1978 Kabele ..... 181/247
4,132,286 A * 1/1979 Hasui et al. ..... 181/265
4,165,798 A * 8/1979 Martinez ..... 181/268
4,531,364 A * 7/1985 Equi ..... 60/314
5,372,530 A * 12/1994 Holtermann et al. ..... 440/89 R
5,959,262 A * 9/1999 Menzel ..... 181/231
5,996,732 A * 12/1999 Burger et al. ..... 181/230
6,041,890 A * 3/2000 Wolf et al. ..... 181/230
6,393,835 B1 * 5/2002 Stoll et al. ..... 60/299
6,457,553 B1 * 10/2002 Goplen et al. ..... 181/272
6,684,633 B1 * 2/2004 Jett ..... 60/312
6,789,644 B1 * 9/2004 Mukaida ..... 181/272
2002/0152747 A1 * 10/2002 Blair et al. ..... 60/314
2004/0040293 A1 * 3/2004 Klimmek et al. ..... 60/314
2004/0245044 A1 * 12/2004 Cerrato-Jay et al. ..... 181/268
2005/0051384 A1 * 3/2005 Breznik ..... 181/269
2005/0150719 A1 * 7/2005 Gorenflo ..... 181/251

FOREIGN PATENT DOCUMENTS

JP 59108815 A * 6/1984
JP 62082217 A * 4/1987

* cited by examiner

*Primary Examiner*—Edgardo San Martin
(74) *Attorney, Agent, or Firm*—Walter Ottesen

(57) ABSTRACT

An exhaust-gas muffler includes a muffler housing (2) having an inlet opening (3) and an outlet (4). The exhaust-gas muffler is especially for the internal combustion engine in a portable handheld work apparatus. At least one attenuating space (5, 5', 5") is configured in the exhaust-gas muffler (1). The exhaust-gas muffler (1) includes at least one resonance pipe (6) to increase power and to reduce the hydrocarbon emissions. The resonance pipe (6) is fluidly connected to the inlet opening (3) and the resonance pipe leads to a backflow of exhaust gases into the combustion chamber (22). For a simple manufacture, it is provided that the exhaust-gas muffler (1) includes lower and upper half shells (8, 7) via which the resonance pipe (6) is at least partially delimited.

18 Claims, 4 Drawing Sheets

EXHAUST-GAS MUFFLER

FIELD OF THE INVENTION

The invention relates to an exhaust-gas muffler, especially an exhaust-gas muffler for an internal combustion engine in a portable handheld work apparatus.

BACKGROUND OF THE INVENTION

U.S. Pat. No. 6,698,194 discloses a two-stroke engine having an exhaust-gas muffler wherein a resonance pipe closed at one end is mounted between the outlet from the engine and the inlet into the exhaust-gas muffler. The resonance pipe is configured as a separate component which can be mounted in the attenuating space of the muffler so as to be wound in a spiral configuration. A resonance pipe of this kind is complex to manufacture.

SUMMARY OF THE INVENTION

It is an object of the invention to provide an exhaust-gas muffler of the kind described above which can be simply manufactured.

The exhaust-gas muffler of the invention is for an internal combustion engine including for an internal combustion engine in a portable handheld work apparatus. The exhaust-gas muffler includes: a muffler housing having an inlet opening and an outlet; the muffler housing including an attenuating space formed therein; a resonance pipe fluidly connected to the inlet opening; and, the muffler housing including an upper half shell and a lower half shell and the half shells at least partially delimiting the resonance pipe.

The manufacture of the exhaust-gas muffler is significantly simplified by at least a partial delimiting of the resonance pipe by an upper half shell and a lower half shell. The half shells can be manufactured in the usual manner as deep-drawn parts. A complex bending process is therefore not necessary as it is in the state of the art.

A partition wall is mounted advantageously between the half shells. The partition wall forms especially a boundary of the resonance pipe. The partition wall can, however, at least partially delimit also the attenuation space of the muffler. It is especially provided that a first longitudinal section of the resonance pipe is bounded or delimited by the lower half shell and the partition wall and a second longitudinal section is delimited by the upper half shell and the partition wall. The resonance pipe can thereby be formed partially above and partially below the partition wall. In this way, the resonance pipe is not arranged only in one plane but in two planes and the length of the resonance pipe can be increased. Advantageously, the partition wall has a connecting opening between the two sections. In this way, the connection of the sections can be integrally configured with the partition wall. No additional components are necessary.

Advantageously, the upper and the lower half shells define the muffler housing. The resonance pipe is thereby configured to be integrated with the muffler housing. The muffler housing can be built up with a low number of components. Especially, the muffler housing essentially includes three components, namely, the upper and the lower half shells and the partition wall. A favorable arrangement and a good utilization of the component space, which is available, result when the outlet is arranged in the lower half shell which includes the inlet opening. To avoid additional components for the attachment of the exhaust-gas muffler, it is provided that the upper half shell, the partition wall and the lower half shell have attachment openings in those regions where they are tightly connected to each other.

The end of the resonance pipe, which faces away from the inlet opening, is configured so as to be closed in order to obtain a good noise attenuation and a high power of the engine. It is practical to configure the inlet into the attenuating space as a diaphragm. In this way, it is achieved that exhaust gas flows back into the combustion chamber and a comparatively high power of the engine at good noise attenuation is obtained. The diaphragm is configured in the partition wall and defines a connection between the attenuating space and the inlet opening.

It can, however, also be practical to configure the diaphragm in a half shell and establish a connection between the end of the resonance pipe, which faces away from the inlet opening, and the attenuating space. The resonance pipe thereby defines the connection between the outlet of the engine and the attenuating space.

High power and good noise attenuation result when the equivalent diameter of the diaphragm measured in millimeters is approximately 1 to 3 times (especially 1.2 to 2.4 times) the square root of the volume of the piston displacement of the engine measured in cubic centimeters. The equivalent diameter characterizes the diameter which a circularly-shaped diaphragm would have which corresponds to the cross-sectional form of the actual diaphragm. The equivalent diameter of the diaphragm is especially variable in dependence upon rpm. In this way, an adaptation of the noise attenuation characteristics to the particular engine rpm is achieved. The equivalent diameter of the resonance pipe amounts approximately to 2.5 to 6 times the square root of the volume of the piston displacement of the engine.

The equivalent diameter of the resonance pipe is advantageously approximately constant over the length thereof. The cross-sectional form of the resonance pipe is also substantially constant over the length thereof. For good attenuating characteristics and a high power of the engine, the length of the resonance pipe is matched to the rpm of the engine, especially to 60% to 100% of the rated rpm. For good exhaust-gas values, the exhaust-gas muffler includes a catalytic converter. Several resonance pipes are advantageously provided of which at least one is configured so that it can be switched in and out. In this way, an adaptation of the noise attenuating characteristics is possible. All resonance pipes are especially configured so that they can be switched in and out so that for each region of application one or several resonance pipes can be selected.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
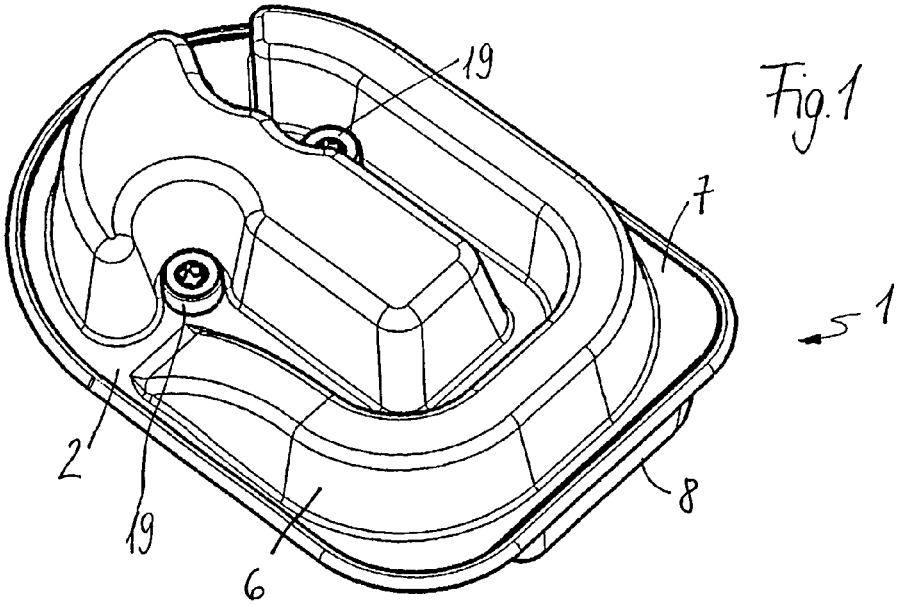
FIG. 1 is a perspective view of an exhaust-gas muffler.

The exhaust-gas muffler 1 shown in FIG. 1 includes a muffler housing 2 which is formed from an upper half shell 7 and a lower half shell 8. The two half shells are formed from deep-drawn sheet metal. The half shells are connected to each other at their edges shown in FIG. 2. The edge 30 of the lower half shell 8 is flange connected to the edge 29 of the upper half shell 7. The upper half shell 7 has two attachment openings 14 and the lower half shell 8 has two attachment openings 15 for fixing the exhaust-gas muffler 1 to the engine. The attachment openings 14 and 15 lie atop each other when joining the half shells 7 and 8. The exhaust-gas muffler 1 can then be fixed with attachment screws 19 to the engine. The attachment screws project through the attachment openings 14 and 15.

An inlet opening 3 is formed in the lower half shell 8 facing toward the engine. The cross section of the inlet opening corresponds to the cross section of the combustion chamber outlet of the engine. The two attachment openings 15 are mounted on both sides of the inlet opening 3. The exhaust-gas muffler 1 includes an attenuating space 5 which comprises an attenuating space 5', which is configured in the upper half shell, and a damping space 5", which is configured in the lower half shell 8. An outlet 4 leads from the attenuating space 5". The outlet 4 is arranged in the lower half shell 8.

The exhaust-gas muffler 1 includes a resonance pipe 6. The length of the resonance pipe is matched to the rpm of the engine, especially in a range of 60% to 100% of the rated rpm of the engine. A first section 10 of the resonance pipe 6 is configured in the lower half shell 8. The second section 11 of the resonance pipe 6 is configured in the upper half shell 7. The resonance pipe 6 extends in a first section 10 from the inlet opening 3 approximately in a spiral shape about the inlet opening 3. In the second section 11, the resonance pipe 6 runs approximately U-shaped along the periphery of the muffler housing 2. The attenuating space 5', which is configured in the upper half shell 7, extends between the legs of the U-shape, which is configured by the second section of the resonance pipe 6, as well as thereabove. The attenuating space 5", which is configured in the lower half shell 8, extends in the region of the lower half shell 8, which lies opposite to the base of the U-shape formed by the second section 11.

Figure 3:
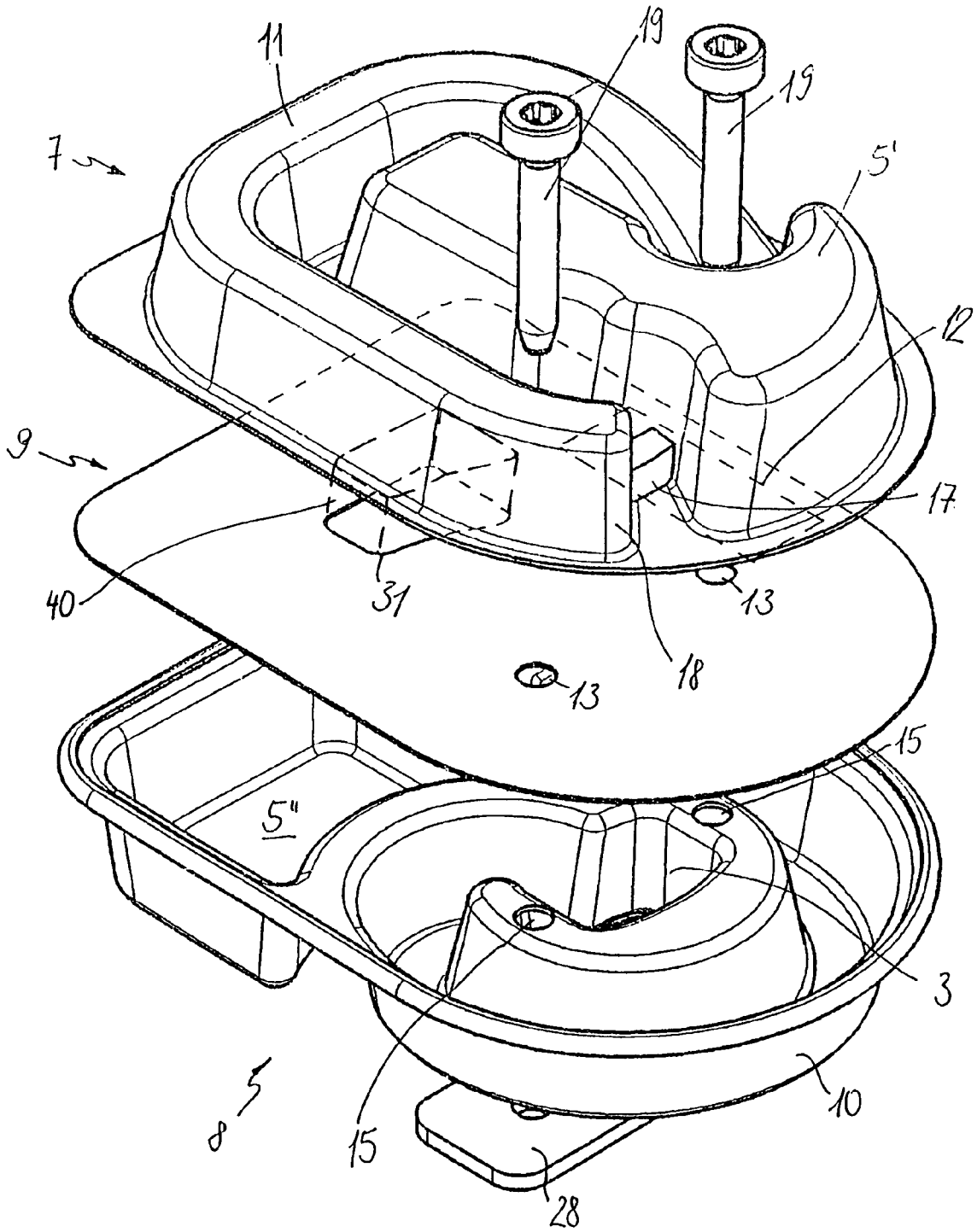
FIG. 3 is an exploded perspective view of the exhaust-gas muffler of FIG. 1 with the partition wall.

As shown in FIG. 3, a partition wall 9 is arranged between the upper half shell 7 and the lower half shell 8. This partition wall likewise has two attachment openings 13 which come to rest between an attachment opening 14 and an attachment opening 15, respectively. In the region of the attachment openings (13, 14, 15), the upper half shell 7, the partition wall 9 and the lower half shell 8 lie seal tight one against the other. As shown in FIG. 3, an attachment flange 28 is provided which functions as a support surface between the exhaust-gas muffler 1 and an internal combustion engine.

Figure 2:
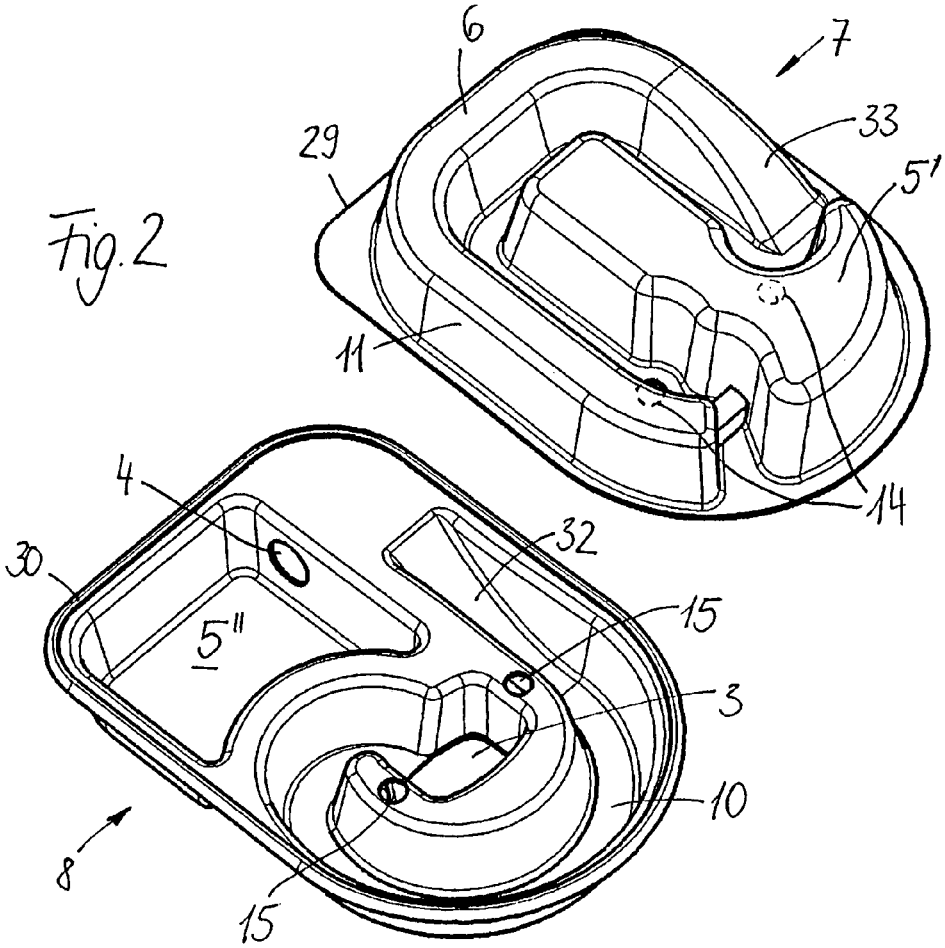
FIG. 2 is an exploded perspective view of the exhaust-gas muffler of FIG. 1 without the partition wall.

The exhaust gases flow from the engine through the inlet opening 3 into the first section 10 of the resonance pipe 6. The inlet opening 3 and the first section of the resonance pipe 6 are limited by the partition wall 9 in a direction toward the upper half shell 7. The cross section of the resonance pipe 6 is approximately constant in the first section 10. As shown in FIG. 2, the resonance pipe 6 has a connecting section 32, which is configured in the lower half shell 8, and a connecting section 33, which is configured in the upper half shell 7. While the depth of the resonance pipe 6 reduces continuously in the connecting section 32, this depth increases continuously in connecting section 33. As shown in phantom outline in FIG. 3, a connecting opening 12 is formed in the partition wall 9 in the region of the connecting sections 32 and 33. This connecting opening 12 thereby extends between the first section 10 and the second section 11. The second section 11 of the resonance pipe 6 joins at the connecting section 33 and is likewise bounded by the partition wall 9 in a direction toward the lower half shell 8. The connecting section 33 defines a leg of the U-shape formed by the second section.

A fluid connection to the attenuating space 5' is established in the region of the end 18 of the resonance pipe 6 facing away from the inlet opening 3. This fluid connection is defined by a diaphragm 17 which is formed by a strut configured in the upper half shell 7 which strut is delimited by the partition wall 9. The equivalent diameter of the diaphragm 17 amounts approximately to 1 to 3 times. (especially 1.2 to 2.4 times) the square root of the volume of the piston displacement of the engine. This volume is measured in cubic centimeters and the equivalent diameter is measured in millimeters. Advantageous attenuating characteristics result especially when the equivalent diameter in millimeters is 1.5 to 2.1 times the square root of the volume of the piston displacement. Advantageously, the diameter of the diaphragm 17 is variable and can so be adapted to different attenuating requirements. The attenuating spaces 5' and 5" conjointly define the attenuating space 5 and are connected to each other via an opening 31 in the partition wall 9. In lieu of the attenuating space 5, it can be practical to provide two attenuating spaces which are configured separate from each other. It is practical when one of the attenuating spaces corresponds to the attenuating space 5' and the other attenuating space to the attenuating space 5". In lieu of the opening 31, a catalytic converter 40 can be mounted in the partition wall 9 as shown in phantom outline in FIG. 3 with this catalytic converter fluidly connecting the two attenuating spaces with each other. It can be advantageous to provide one or several additional resonance pipes. Especially, individual or all resonance pipes are configured so that they can be switched in and out.

Figure 4:
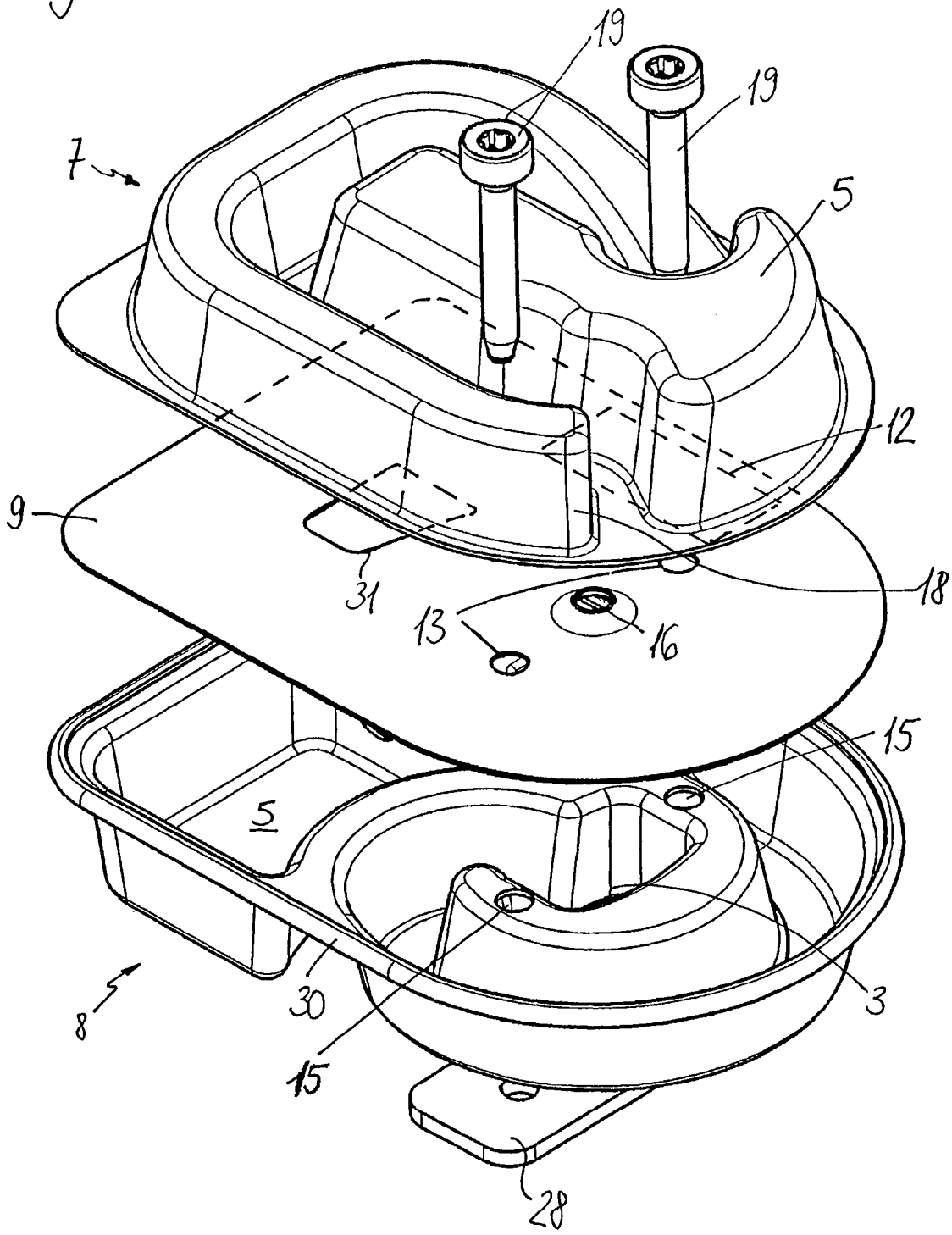
FIG. 4 is an exploded perspective view of the exhaust-gas muffler with a closed resonance pipe; and, FIG. 5 is a schematic side elevation view, in section, of an internal combustion engine equipped with an exhaust-gas muffler according to the invention.

FIG. 4 shows another embodiment of the invention wherein the same reference numerals identify corresponding components.

The end 18 of the resonance pipe 6, which is facing away from the inlet opening 3, is configured so as to be closed. The resonance pipe is thereby fluidly connected only to the inlet opening 3. A diaphragm 16 is provided in the region of the inlet opening 3 and this diaphragm opens into the attenuating space 5. The diaphragm 16 is designed in correspondence to the diaphragm 17 shown in FIG. 3 and advantageously has a changeable cross section. The diaphragm 16 can, for example, be configured as an aperture diaphragm. Exhaust gas, which flows in through the inlet opening 3, can thereby flow into the resonance pipe 6. Here, the exhaust gas is, however, simply stored because the resonance pipe 6 is closed. Simultaneously, the exhaust gas can flow through the diaphragm 16 into the attenuating chamber 5 and from there to the outlet 4. By changing the arrangement of the diaphragm, which leads into the attenuating space 5, the arrangement of the resonance pipe 6 can thereby be basically changed. In the embodiment shown in FIG. 3, the resonance pipe 6 and the attenuating space 5 are arranged one behind the other in the flow direction of the exhaust gas. In the embodiment of FIG. 4, resonance pipe 6 and attenuating space 5 are mounted parallel to each other in the flow path. Advantageously, one or several additional resonance pipes are provided.

Figure 5:
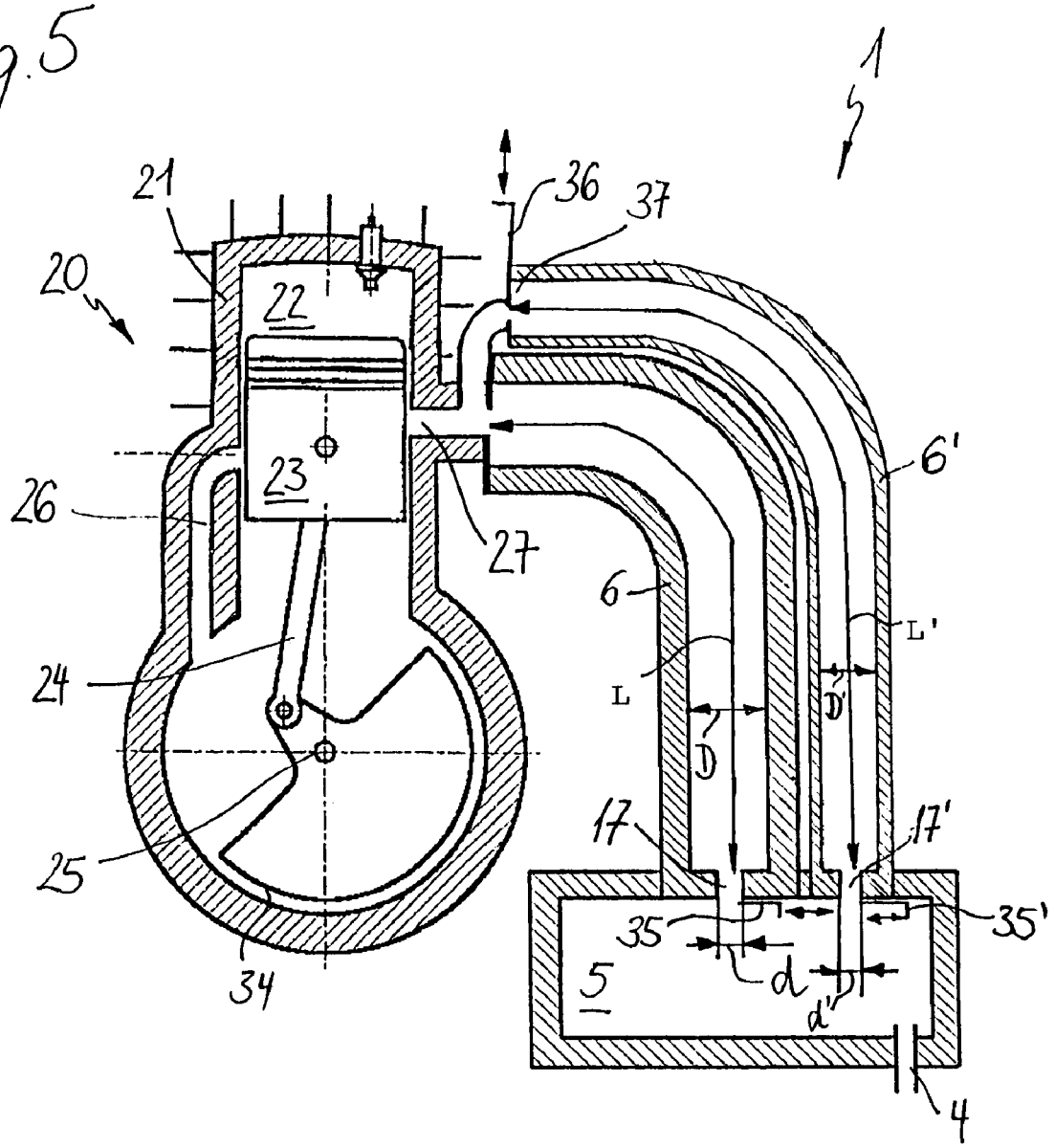

In FIG. 5, an internal combustion engine 20 is shown schematically with an exhaust-gas muffler 1. The resonance pipes (6, 6') are arranged in flow direction of the exhaust gas ahead of the attenuating space 5. The engine 20 is configured as a two-stroke engine and has a combustion chamber 22 configured in a cylinder 21. The combustion chamber 22 is delimited by a reciprocating piston 23 which drives a crankshaft 25 via a connecting rod 24. The crankshaft 25 is rotatably journalled in a crankcase 34. The crankcase 34 is fluidly connected to the combustion chamber 22 in the region of bottom dead center of the piston 23 via a transfer channel 26. A combustion chamber outlet 27 leads from the combustion chamber 22 and the outlet 27 is opened in the region of bottom dead center of the piston 23.

The combustion chamber 22 is fluidly connected to the combustion chamber outlet 27 in the region of bottom dead center of the piston 23. Exhaust gases flow from the combustion chamber 22 through the combustion chamber outlet 27 into the resonance pipes (6, 6'). The resonance pipes (6, 6') have a length L and L', respectively, and have the diameters (D, D'). The diameter D is constant over the length L. The resonance pipes (6, 6') open into the attenuating space 5. The connections between the resonance pipes (6, 6') and the attenuating space 5 are configured as diaphragms (17, 17') which have diameters (d, d'), respectively, which are less than the respective diameters (D, D') of the resonance pipes (6, 6'). The lengths (L, L') of the resonance pipes (6, 6') as well as their diameters (D, D') can be equal. For attenuating different frequencies, the resonance pipes (6, 6') have, however, different lengths (L, L') and diameters (D, D'). The exhaust gas flows from the attenuating space 5 through the outlet 4.

Exhaust gas flows into the resonance pipes (6, 6') during operation of the engine 20. Because of the small diameters (d, d') of the diaphragms (17, 17') the exhaust gas is stored in the resonance pipes (6, 6'). At the end of the charge exchange, the flow direction is reversed in the combustion chamber outlet 27 so that exhaust gas from the resonance pipes (6, 6') flows back into the combustion chamber 22. Because of the backflow of exhaust gas into the combustion chamber 22, the emission of hydrocarbons from the outlet 4 of the exhaust-gas muffler 1 is reduced up to 30%. This is likewise achieved with an exhaust-gas muffler wherein the attenuating space 5 is connected directly to the combustion chamber outlet 27 in correspondence to the embodiment of FIG. 4 and the resonance pipes (6, 6') are configured as closed pipes.

A slider 35 is shown schematically in FIG. 5 and is provided for changing the flow cross section of the diaphragm 17. The change of the flow cross section can, however, be achieved in other ways. Correspondingly, a slider 35' for changing diameter is arranged on the diaphragm 17'. The change of the flow cross section of the diaphragms (17, 17') takes place especially in dependence upon the rpm of the engine 20. The resonance pipe 6' can be switched in or switched out. For this purpose, a slider 36 is mounted on the end 37 of the resonance pipe 6' which faces toward the engine 20. The resonance pipe 6' can be switched in with the slider 36. It can be practical to provide additional resonance pipes, especially resonance pipes which can be switched in having the same or other dimensions. It can be advantageous to configure all resonance pipes so that they can be switched in and out so that one or several resonance pipes can be selected via a corresponding switching.

It can be practical that the partition wall 9 only extends in one section between upper half shell and lower half shell. It can be practical to configure the resonance pipe 6 between upper and lower half shells and to arrange the attenuating chamber 5 in the interior of a muffler housing including upper and lower half shells. In this way, the muffler volume can be increased for the same structural space.

It is understood that the foregoing description is that of the preferred embodiments of the invention and that various changes and modifications may be made thereto without departing from the spirit and scope of the invention as defined in the appended claims.

What is claimed is:

1. An exhaust-gas muffler for an internal combustion engine including for an internal combustion engine in a portable handheld work apparatus, the exhaust-gas muffler comprising:

a muffler housing having an inlet opening and an outlet; said muffler housing including an attenuating space formed therein;

a resonance pipe fluidly connected to said inlet opening; said muffler housing including an upper half shell and a lower half shell and said half shells at least partially delimiting said resonance pipe;

a partition wall being mounted between said half shells; said partition wall delimiting said resonance pipe; and, a first longitudinal section of said resonance pipe being formed by said lower half shell and said partition wall and a second longitudinal section of said resonance pipe being formed by said upper half shell and said partition wall.

2. The exhaust-gas muffler of claim 1, wherein said partition wall defines a connecting opening between said first and second longitudinal sections.

3. The exhaust-gas muffler of claim 1, wherein said upper and lower half shells conjointly define said muffler housing.

4. The exhaust-gas muffler of claim 1, wherein said lower half shell includes said inlet opening; and, said outlet is formed in said lower half shell.

5. The exhaust-gas muffler of claim 1, wherein said housing has attachment openings; and, said upper half shell, said lower half shell and said partition wall are connected seal tight to each other in the region of said attachment openings.

6. The exhaust-gas muffler of claim 1, wherein the end of said resonance pipe facing away from said inlet opening is configured to be closed.

7. The exhaust-gas muffler of claim 1, wherein said inlet opens into said attenuating space as a diaphragm.

8. The exhaust-gas muffler of claim 7, wherein said diaphragm is configured in said partition wall and establishes a connection between said attenuating space and said inlet opening.

9. The exhaust-gas muffler of claim 7, wherein said diaphragm is configured in one of said half shells and establishes a connection between the end of said resonance pipe facing away from said inlet opening and said attenuating space.

10. The exhaust-gas muffler of claim 7, wherein said diaphragm has an equivalent diameter (d, d') measured in millimeters which amounts to approximately 1 to 3 times the square root of the volume of the piston displacement of said engine with said volume being measured in cubic centimeters.

11. The exhaust-gas muffler of claim 7, wherein said diaphragm has an equivalent diameter (d, d') measured in millimeters which amounts to approximately 1.2 to 2.4 times the square root of the volume of the piston displacement of said engine with said volume being measured in cubic centimeters.

12. The exhaust-gas muffler of claim 11, wherein said equivalent diameter (d, d') is variable in dependence upon the rpm of said engine.

13. The exhaust-gas muffler of claim 12, wherein said resonance pipe has an equivalent diameter (D) measured in millimeters which amounts to approximately 2.5 to 6 times the square root of the volume of the piston displacement of said engine with said volume being measured in cubic centimeters.

14. The exhaust-gas muffler of claim 13, wherein said equivalent diameter (D) of said resonance pipe is approximately constant over the length (L) thereof.

15. The exhaust-gas muffler of claim 1, wherein the length (L) of said resonance pipe is matched to the engine speed (rpm) of said engine.

16. The exhaust-gas muffler of claim 1, wherein the length (L) of said resonance pipe is matched to 60% to 100% of the rated rpm of said engine speed (rpm).

17. The exhaust-gas muffler of claim 1, further comprising a catalytic converter.

18. The exhaust-gas muffler of claim 1, wherein said resonance pipe is one of a plurality of resonance pipes; and, wherein said exhaust-gas muffler further comprises means for switching in and out at least one of said resonance pipes.

* * * * *